US007482940B2

(12) United States Patent
Rutter et al.

(10) Patent No.: US 7,482,940 B2
(45) Date of Patent: Jan. 27, 2009

(54) ALARM FOR DETECTING RADIATION AND POLLUTANTS

(75) Inventors: Nicholas Alexander Rutter, Coventry (GB); Stuart Hart, Coventry (GB)

(73) Assignee: AngelEye Inc., Wilmington, DE (US)

( * ) Notice: Subject to any disclaimer, the term of this patent is extended or adjusted under 35 U.S.C. 154(b) by 112 days.

(21) Appl. No.: 10/518,919

(22) PCT Filed: Jun. 24, 2003

(86) PCT No.: PCT/GB03/02714

§ 371 (c)(1),
(2), (4) Date: Apr. 27, 2005

(87) PCT Pub. No.: WO04/001692

PCT Pub. Date: Dec. 31, 2003

(65) Prior Publication Data

US 2006/0103540 A1 May 18, 2006

Related U.S. Application Data

(60) Provisional application No. 60/390,369, filed on Jun. 24, 2002.

(51) Int. Cl.
*G08B 29/00* (2006.01)
*G08B 17/10* (2006.01)

(52) U.S. Cl. ..... 340/628; 340/514; 340/629; 340/630; 340/632

(58) Field of Classification Search ..... None
See application file for complete search history.

(56) References Cited

U.S. PATENT DOCUMENTS

| | | | |
|---|---|---|---|
| 3,846,773 | A | 11/1974 | Lintelmann et al. |
| 4,893,324 | A | 1/1990 | Scown |
| 5,432,500 | A | 7/1995 | Scripps |
| 6,348,872 | B1 | 2/2002 | Otani et al. |

FOREIGN PATENT DOCUMENTS

| | | |
|---|---|---|
| WO | WO 00/21047 A1 | 4/2000 |
| WO | WO 00/58924 A1 | 10/2000 |

*Primary Examiner*—Julie Lieu
(74) *Attorney, Agent, or Firm*—Oliff & Berridge, PLC

(57) ABSTRACT

An alarm for detecting radiation and/or pollutants such as smoke, carbon monoxide or the like has a housing (500), an alarm circuit (400) including a detector (DET1) for detecting said radiation and/or pollutants, first electrical connections (PL1, PL2) connectable to an external power supply for supplying power to the alarm circuit, and a control circuit (300) responsive to receipt of a preselected number of pulses over a preselected time period to apply a preset control signal to the alarm circuit (400). The alarm circuit (400) is responsive to the preset control signal to reset or test the alarm in dependence on the preset control signal.

26 Claims, 12 Drawing Sheets

100
200
Vcc
800
Vcc
300
Vcc
400

210
D
550

111
D9
R40
200
D3
R30
B1
C
B
C
B
A
R31
TR5
111
R38
R39
R7
R8
IC1
IN
OUT
REF
2
4
1
C2
D2
110
R2
R8
Not
fitted
R3
R4
301
BR1
AC
AC
3
1
2
4
+
-
112
R36
VAR 1
R37
R1
R34
N
PL2
L
PL1
100

FIG 8
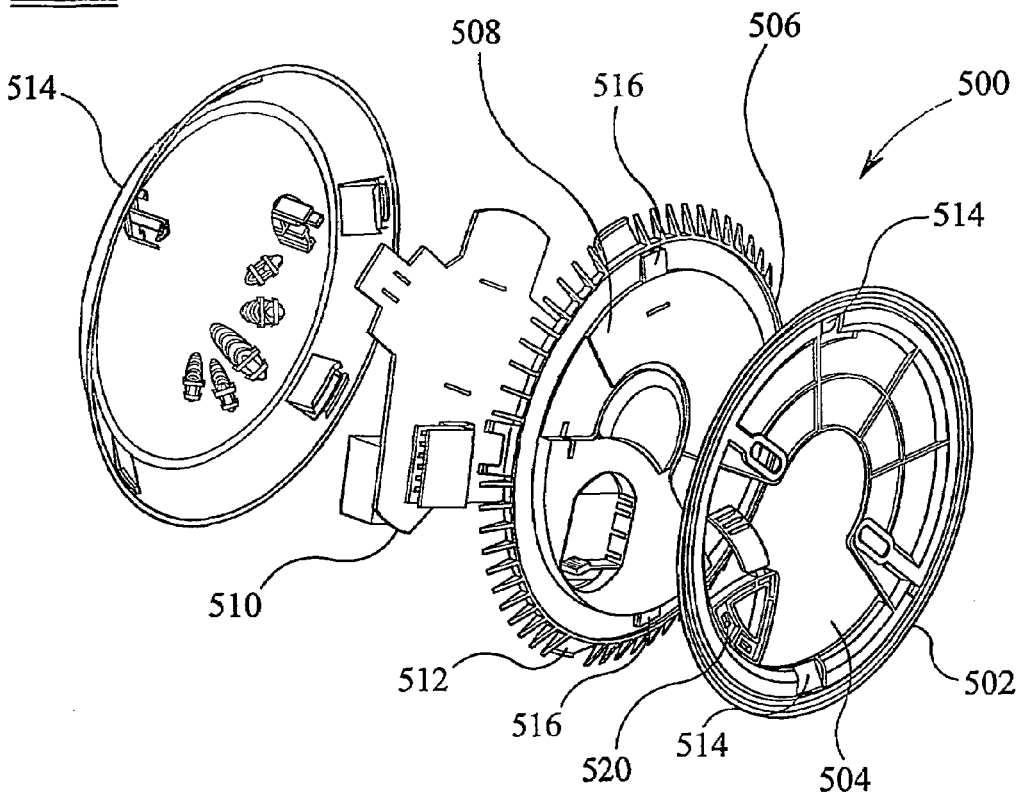
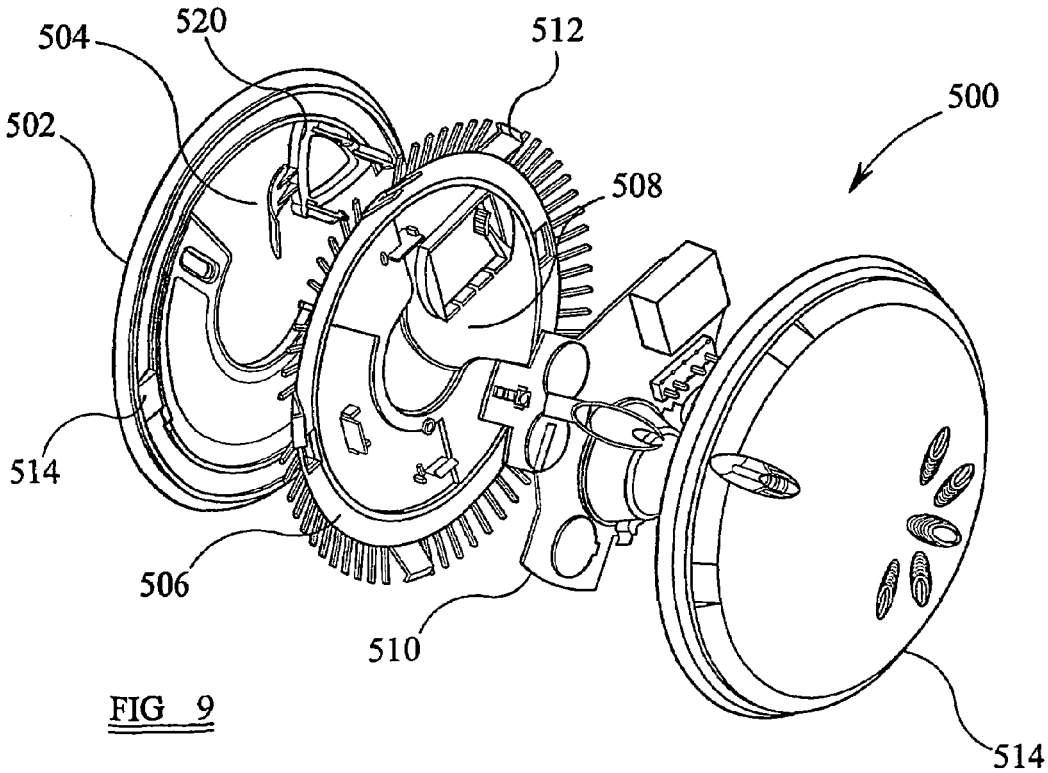
FIG 9

FIG 19
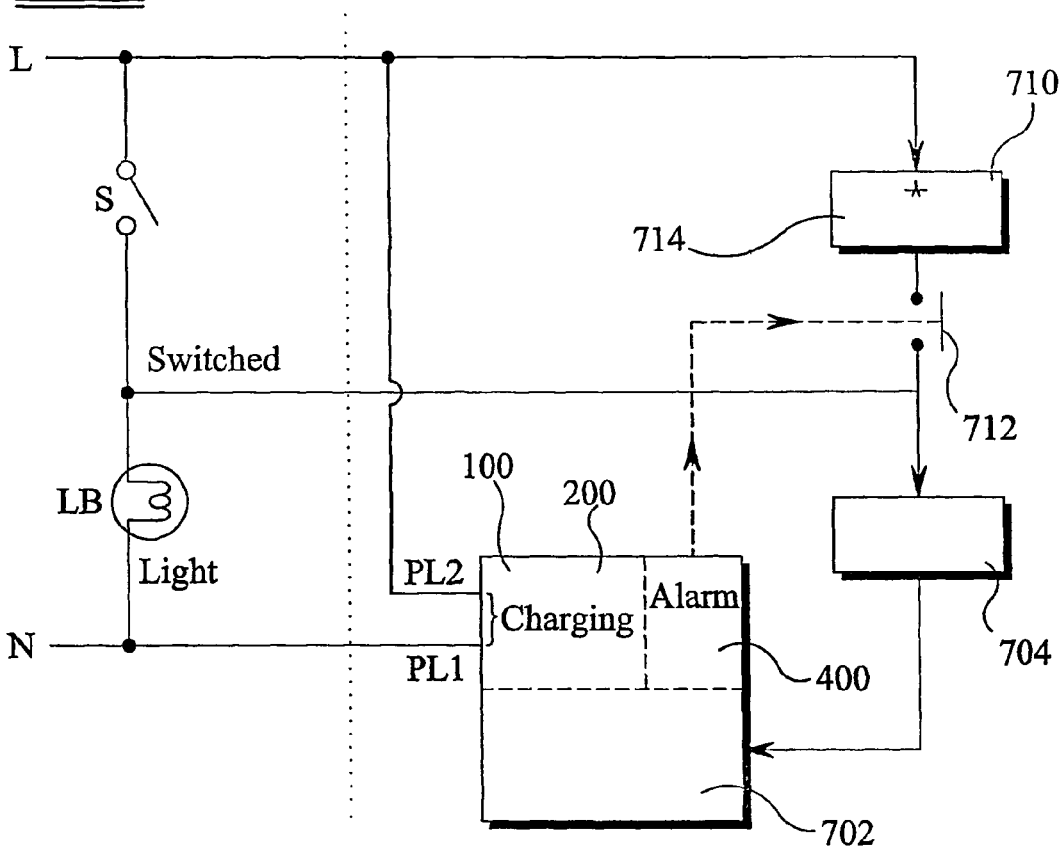
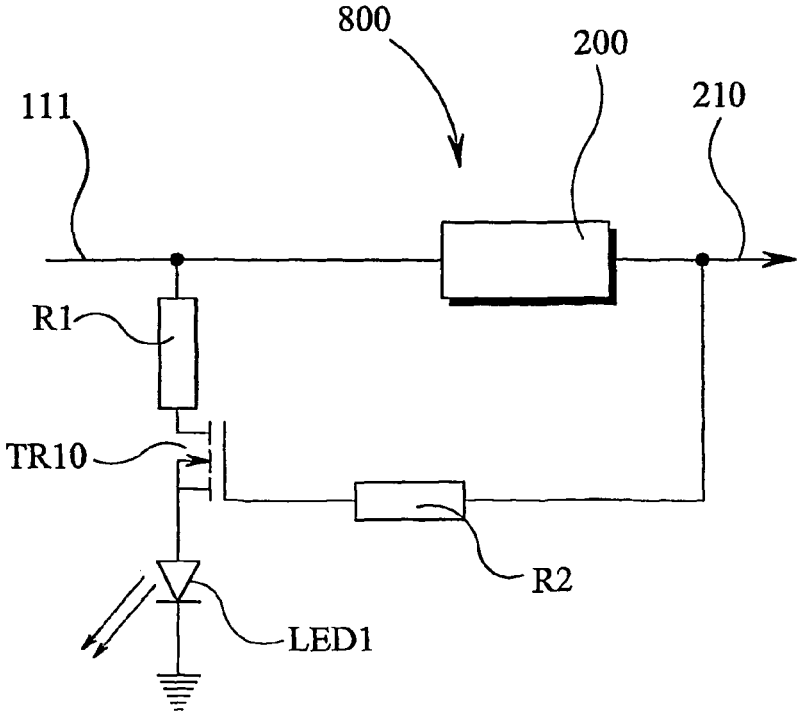
FIG 20

ALARM FOR DETECTING RADIATION AND POLLUTANTS

The present invention relates to an alarm and particularly, but not exclusively, to an improved form of mains-powered smoke alarm.

Until recently, smoke alarms and other types of alarms for detecting radiation, heat and air pollutants or the like, were relatively bulky devices powered only by means of a battery. No provision for recharging the battery was included and thus correct operation of the alarm required the regular changing of the battery to ensure the alarm remained powered. Owing to an increasing awareness of the need for such alarms in domestic buildings and offices, it has become common to provide alarms which are mains-powered and which include a rechargeable battery for powering the alarm in the event that mains power is disrupted.

An improvement to general mains powered smoke alarms are alarms which can be connected to a lighting circuit. International Patent Application publication No. WO00/21407 discloses an alarm for detecting radiation and/or pollutants such as smoke, carbon monoxide or the like which is arranged to interconnect between a light fitting and a light source such as a bulb. The alarm is powered by the light fitting when the light fitting is energised and is powered by a battery when the light fitting is de-energised.

International Patent Application publication No. WO 00/58924 discloses an alarm for detecting radiation and/or pollutants such as smoke, carbon monoxide, methane, radon or the like comprising a housing which is intended to replace a ceiling rose for a light fitting.

The above described devices permit relatively easy installation to existing lighting circuits but suffer the disadvantage that a light fitting, such as a batten or pendant ceiling fitting, is required for such installation. It is difficult or impossible to install such devices at locations in a building where there are no light fittings. Building regulations currently often require that mains-powered alarms be fitted at specific areas within buildings which may not coincide with the position of light fittings.

It is an aim of the present invention to provide an improved mains-powered alarm connectable in a lighting circuit or other mains circuit. It is a further aim of the invention to provide an alarm which is more easily installed and which does not require to be fitted in conjunction with a light fitting.

The present invention provides an alarm for detecting radiation and/or pollutants such as smoke, carbon monoxide or the like having: a housing means; an alarm circuit including detection means for detecting said radiation and/or pollutants; first electrical connection means connectable to an external power supply for supplying power to said alarm circuit; and control means responsive to receipt of a preselected number of pulses over a preselected time period to apply a preset control signal to said alarm circuit; wherein said alarm circuit is responsive to said preset control signal to reset or test said alarm in dependence on said preset control signal.

In a preferred form of the invention said control means is responsive to the energising and de-energising of the external power supply said preselected number of times over said preselected time period to apply said preset control signal to said alarm circuit. Said alarm has first switch means actuable by a user to generate a respective pulse for each actuation thereby to apply a user selected number of pulses to said control means; and said control means is responsive to receipt of said preselected number of said pulses over said preselected time period to apply a preset control signal to said alarm circuit.

Preferably, said first switch means is mounted on said alarm housing.

Preferably, said first switch means is mounted remote from said alarm housing.

Preferably, said first switch means is adapted for connection to a switch live side of a switch for a lighting circuit.

Preferably, said alarm has second electrical connection means for connection to a switch live side of a switch for a lighting circuit; and wherein said second electrical connection means is operable to receive pulses caused by user actuation of said switch between its on and off states and apply said pulses to said control means thereby to cause a preset control signal to be applied to said alarm circuit in response to generation of said preselected number of pulses over said preselected time period.

Preferably, switch means for an external light source are provided and are actuable in response to generation of a preselected control signal to energise said light source.

Preferably, the alarm comprises a relay and a light source wherein said relay is actuable in response to generation of a preselected control signal to energise said light source.

Preferably, when said preselected number of pulses over said preselected time period is one, said control means is operable to apply a preset control signal to said alarm circuit thereby to reset said alarm.

Preferably, said alarm circuit comprises means for reducing the sensitivity of said detection means.

Preferably, said means for reducing the sensitivity of said detection means is operable in response to generation of a reset control signal by said control means to reduce the sensitivity of said detection means for a preselected time period thereby to reset said alarm.

Preferably, said alarm circuit comprises means for increasing the sensitivity of said detection means.

Preferably, said means for increasing the sensitivity of said detection means is operable in response to generation of a test control signal by said control means to increase the sensitivity of said detection means for a preselected time period thereby to test said alarm.

Preferably, the alarm comprises a battery for supplying power to said alarm in the absence of mains power, and a charging circuit including said first electrical connection means for supplying power to a power rail for said alarm and for charging said battery.

Preferably, the alarm comprises isolating means for selectably electrically disconnecting said battery from said alarm thereby to minimise leakage from said battery when said alarm is inactive.

Preferably, said isolating means comprises a second switch means in said power rail switchable between a first, conducting state connecting said battery to said alarm and a second, non-conduction state disconnecting said battery from said alarm.

Preferably, said charging circuit comprises a third switch means switchable between a first, conducting state and a second, non-conducting state in dependence on the voltage on said power rail; and wherein: when said third switch means is in said first, conducting state said third switch means is operable to retain said isolating second switch means in its conducting state; and when said third switch means is in said second, non-conducting state the state of said third switch means is dependent on the voltage on said power rail such that said second switch means is non-conducting in response to said voltage on said power rail being below a preselected value indicating a low battery charge, thereby to disarm said alarm during charging of said battery.

Preferably, the alarm comprises a disconnect means actuable to switch said switch means into its non-conducting state thereby disabling said switch means and preventing actuation of said alarm.

Preferably, said disconnect means comprises button means movable between a first, OFF position wherein said switch means is rendered non-conducting and a second, ON position wherein said switch means is enabled.

Preferably, said switch means is a multi electrode semiconductor device having a control electrode for controlling conduction between further electrodes thereof; and said button means is movable into its first, OFF position to vary the potential on said control gate means thereby to render said switch means non-conducting.

Preferably, said housing comprises: a first backing plate for mounting on a surface; a second backing plate detachably mountable on said first backing plate; and a cover means for covering said backing plates; and wherein the arrangement of said disconnect means is such that engagement of said second backing plate on said first backing plate moves said disconnect means into its second, ON position thereby to enable said switch means and disengagement of said second backing plate from said first backing plate moves said disconnect means into its first, OFF position thereby to disable said switch means.

Preferably, the alarm comprises indicator means operable in response to power on said voltage rail downstream of said isolating means to indicate that said alarm is enabled.

The present invention also provides an alarm for detecting radiation and/or pollutants such as smoke, carbon monoxide or the like having: a housing means; an alarm circuit including detection means for detecting said radiation and/or pollutants; first electrical connection means connectable to an external power supply for supplying power to said alarm circuit; and switch means for a light source, said switch means being actuable in response to triggering of said alarm to energise said light source.

Preferably, said switch means comprises a relay and said light source is external to said alarm.

Preferably, said light source is mounted in said alarm.

The present invention further provides an alarm for detecting radiation and/or pollutants such as smoke, carbon monoxide or the like having: a housing means; an alarm circuit including detection means for detecting said radiation and/or pollutants; first electrical connection means connectable to an external power supply for supplying power to said alarm circuit; a battery for supplying power to said alarm in the absence of mains power; a charging circuit including said first electrical connection means for supplying power to a power rail for said alarm and for charging said battery; and an isolating means for selectably electrically disconnecting said battery from said alarm thereby to minimise leakage from said battery when said alarm is inactive.

Preferably, said isolating means comprises a second switch means in said power rail switchable between a first, conducting state connecting said battery to said alarm and a second, non-conduction state disconnecting said battery from said alarm.

Preferably, said charging circuit comprises a third switch means switchable between a first, conducting state and a second, non-conducting state in dependence on the voltage on said power rail; and wherein: when said third switch means is in said first, conducting state said third switch means is operable to retain said isolating second switch means in its conducting state; and when said third switch means is in said second, non-conducting state the state of said third switch means is dependent on the voltage on said power rail such that said second switch means is non-conducting in response to said voltage on said power rail being below a preselected value indicating a low battery charge, thereby to disarm said alarm during charging of said battery.

Preferably, the alarm comprises a disconnect means actuable to switch said switch means into its non-conducting state thereby disabling said switch means and preventing actuation of said alarm.

Preferably, said disconnect means comprises button means movable between a first, OFF position wherein said switch means is rendered non-conducting and a second, ON position wherein said switch means is enabled.

Preferably, said switch means is a multi electrode semiconductor device having a control electrode for controlling conduction between further electrodes thereof; and said button means is movable into its first, OFF position to vary the potential on said control gate means thereby to render said switch means non-conducting.

Preferably, said housing comprises: a first backing plate for mounting on a surface; a second backing plate detachably mountable on said first backing plate; and a cover means for covering said backing plates; and wherein the arrangement of said disconnect means is such that engagement of said second backing plate on said first backing plate moves said disconnect means into its second, ON position thereby to enable said switch means and disengagement of said second backing plate from said first backing plate moves said disconnect means into its first, OFF position thereby to disable said switch means.

Preferably, the alarm further comprises indicator means operable in response to power on said voltage rail downstream of said isolating means to indicate that said alarm is enabled.

The present invention will now be described, by way of example only, with reference to the accompanying drawings in which:

FIG. 8 is a first perspective view of a housing for the alarm of FIG. 1;

FIG. 9 is a second perspective view of the housing of FIG. 8;

FIG. 19 is a block diagram of the circuit of a further form of alarm; and

FIG. 20 is a schematic diagram of a power on circuit for the disconnect circuit of FIG. 3.

While the following description is made with reference to a smoke alarm, it will be understood that the invention is applicable to other types of alarms, such as those for detecting radiation, air pollutants such as methane, radon or carbon monoxide, and/or heat or the like. In addition, the term "earth" in the context of a voltage or potential is used in the following description conveniently to refer to a reference or signal earth potential, which may or may not be equal to true earth potential, and no limitation to zero volts or true earth potential is intended.

It should also be noted that the symbol Vcc is used to indicate a connection to a supply rail of the alarm circuit whilst the symbol of an inverted triangle is used to represent a connection to an earth rail of the circuit.

Figures 1, 2, 3:
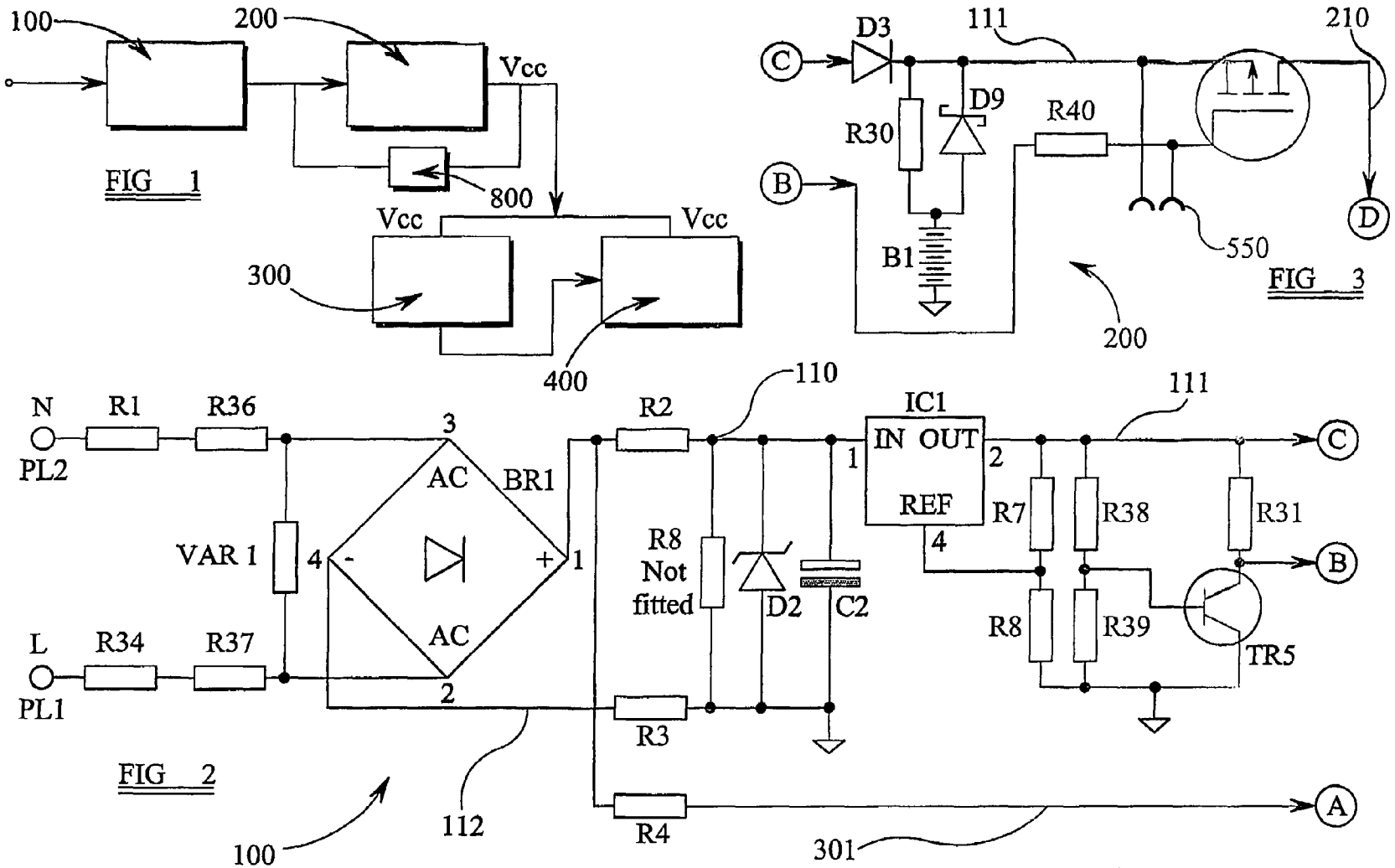
FIG. 1 is a block circuit diagram of a preferred form of alarm according to the invention.
FIG. 2 is a schematic circuit diagram of a charging circuit of the alarm of FIG. 1.
FIG. 3 is a schematic circuit diagram of a disconnect circuit of the alarm of FIG. 1.

Referring firstly to FIG. 1, this shows a block circuit diagram for a preferred form of alarm according to the invention. The alarm circuit has a charging circuit 100, an isolating or disconnect circuit 200, a control circuit 300, an alarm detection circuit 400 and a power on warning circuit 800.

The charging circuit provides a rectified and smoothed voltage for the control and detection circuits 300, 400 whilst the disconnect circuit 200 controls the application of the supplied voltage to the control and detection circuits 300, 400.

The circuits 100 to 800 will be well understood by those skilled in the art and for convenience, therefore, only those features of the circuits which are important for the understanding (and not necessarily the operation) of the invention are described in detail.

The charging circuit 100 is shown in detail in FIG. 2 and includes first and second inputs PL1, PL2 for connection to the live and neutral cables of an AC power supply. In the illustrated embodiment, the AC power supply is formed by the live and neutral cables of an existing mains lighting or ring circuit such as may be found in domestic or office buildings. The first input PL1 is connected to the switched live cable for the lighting circuit so that power is only supplied to the charging circuit 100 when the light is switched on. The phrase "switched live" as used herein refers to the cable which connects the light switch of the lighting circuit to a lamp of the circuit such that when the switch is closed, power is applied through the cable to the lamp.

The first and second inputs PL1, PL2 of the charging circuit are connected to respective inputs of a diode rectifier or rectifier bridge BR1 which serves to apply full-wave rectification to the AC voltage, thereby generating a DC voltage.

The outputs of the rectifier bridge BR1 form positive and earth rails 110, 112 for the charging circuit 100. The rectified DC voltage is applied to the positive rail 110 and a smoothing capacitor C2 is connected between the positive and earth rails 110, 112 for smoothing the DC current from the rectifier bridge BR1. A Zener diode 108 is reverse biased across the positive and earth rails 110, 112 for clipping the voltage output of the rectifier bridge BR1 and hence isolating the further circuitry in the charging circuit from voltage spikes on the power supply.

The DC voltage from the bridge rectifier BR1 is applied to the input of a voltage regulator IC1 which serves to regulate the voltage. The output of the voltage regulator forms a charging rail 111 and the reference input of the voltage regulator is connected to the junction between two reference resistors R7, R8, connected in series between the charging rail 111 and the earth rail 112.

The charging circuit further includes a switch in the form of a transistor TR5 whose collector is connected to the charging rail 111 via a resistor R31. The emitter of the transistor TR5 is connected to the earth rail 112 and the base is connected to a potential divider formed by two resistors R38, R39 connected in series between the charging and earth rails 111, 112. The purpose of the transistor TR5 is described below.

FIG. 3 illustrates the disconnect circuit 200. The disconnect circuit 200 is connected to the charging circuit 100 via the charging rail 111 at point C and to the collector of the transistor TR5 at point B. The disconnect circuit 200 includes a rechargeable cell or battery B1, the positive terminal of which is connected to the charging rail 111 via a parallel combination of a resistor R30 and a Schottky diode D9. The negative terminal of the cell B1 is connected to the earth rail 112. The charging rail 111 is connected to the source of a P-type Field Effect Transistor (FET) TR3, the drain of which is connected to and forms a supply rail 210 for the remaining circuitry of the alarm as described below.

The gate of the FET TR3 is connected, via a limiting resistor R40 to the collector of the transistor TR5 at point B. In addition, the source and gate of the FET TR3 are arranged to be connected together or disconnected by means of a connection arrangement 550. The connection arrangement 550 may be of any suitable type which permits the easy and selective connection and disconnection of the source and gates of the FET TR3. For example, it may be achieved by a fuse-type connector, a jumper or even a manual switch. An important element of this feature is that the source and gate of the FET TR3 are quickly and easily connected or disconnected by a user of the smoke alarm. A preferred form of connection arrangement is described in detail below with reference to FIGS. 11 to 13.

Operation of the recharging and disconnect circuits 100, 200 will now be described. The AC voltage from the mains supply is applied to the inputs PL1, PL2 and the alternating current is full-wave rectified to a DC signal by means of the diode bridge BR1. The DC voltage across the positive and earth rails 110, 112 is smoothed by means of the smoothing capacitor C2 and is regulated by the voltage regulator IC1. During periods when the charging circuit is operable (i.e. while the AC voltage is applied to the inputs PL1, PL2) a DC voltage is applied to the base of the transistor TR5 which is thus switched on.

With the transistor TR5 switched on, the potential at the collector of the transistor TR5 is "pulled down" to approximately the potential on the earth rail 112 thus pulling down the gate of the FET TR3 which is connected to the collector of TR5. Since the FET TR3 is a P-type device, a relatively low potential applied to the gate thereof causes the FET TR3 to switch on. Power from the charging circuit 100 is thus supplied via the voltage regulator IC1 and the FET TR3 to the supply rail 210 for distribution to the further circuitry of the alarm. In addition, current on the charging rail 111 flows through the resistor R30 for charging the rechargeable battery B1.

It is envisaged that the input PL1 may be connected to the switched live cable of, for example, a lighting circuit for a light bulb (not shown) so that power will be applied to the charging circuit 100 from the lighting circuit when the lighting circuit is switched on. During periods when the lighting circuit is de-energised (i.e. the light is switched off), power to the supply rail 210 is provided by means of the rechargeable battery B1. Since, during such periods, no power is supplied to the inputs PL1, PL2, the potential on the charging rail 111 is substantially the same as that on the earth rail 112.

Since the potential applied to the collector of the transistor TR5, and hence to the gate of the FET TR3, is low, the latter remains switched on even through the transistor TR5 is switched off. Current is thus supplied to the further circuitry of the alarm from the battery B1 via the FET TR3.

It will be understood that there may be some circumstances in which the charging circuit is not be used for some considerable time. One such circumstance is when the alarm is in transit (i.e. before installation) or during shipping from manufacturer to retailer. In these circumstances, clearly, no charging current is available and the battery continues to provide power to the alarm even though the alarm is not required to be operative. As a result, over a period of time the battery B1 will lose its charge. While this is acceptable in some circumstances, it would be advantageous to reduce the current drain from the battery to a minimal level.

A solution to this problem as provided by the present invention is to enable the battery B1 to be selectively disconnected from the remaining circuitry of the alarm in order to eliminate or minimise the current drain from the battery. This is achieved through the connection means 550. The connection means 550 is connected across the charging rail 111 and the gate of the FET TR3 and is arranged selectively to connect the source of the FET TR3 to the gate thereof. In this state, the FET TR3 is effectively shorted out and the voltage applied to the gate rises from earth potential to a level close to that provided on the charging rail 111 by the battery B1.

This raised voltage on the gate causes the FET TR3 to switch off thereby preventing current flow from the battery B1 to the remainder of the circuitry. It will be noticed from FIGS. 2 and 3 that current paths from the battery B1 still exist through the resistors R40, R31 and then via R7, R8 and R38, R39. However, the limiting resistor R40 preferably has a resistance in the order of MegaOhms, which is sufficiently high to reduce significantly the current flow from the battery B1.

Advantageously, the connection arrangement 550 may be arranged so that the source and gates of the FET TR3 are shorted by default until such time as the alarm is installed, as described later.

It will be understood that the above described mechanism enables the battery B1 to retain a usable charge for a considerable length of time before it is required to be recharged. Thus, alarms which are shipped with their batteries installed will still retain sufficient charge to be operable after sale by the retailer. This avoids the common problem whereby mains powered alarms which employ rechargeable batteries as back up power supplies are unable to charge the battery if the charge on the battery drops below a certain level as described below.

Another circumstance in which the charging circuit may not be used for some considerable time is when, after installation of the alarm, the lighting circuit is not energised for a long period of time. In these circumstances no recharging power is available and the smoke alarm circuitry is powered solely by the battery B1.

A problem with conventional smoke alarms is that, when the charge on the battery drops below a predetermined level, the operation of the alarm can become unstable and unpredictable and the alarm will often revert to a constant alarm condition. In this case, switching on the lighting circuit in order to charge the battery may be unsuccessful since the extra current required to power the triggering alarm may exceed that available or required to charge the battery. There will thus be little or no current available to charge the battery and the circuit will continue to alarm or "bog down", thus preventing the battery from being charged.

Conventional smoke alarms do not possess any means to prevent this and often require the removal of the rechargeable battery and the independent recharging thereof. However, for devices having non-removable rechargeable batteries, it is not possible to recharge the battery and the alarm as a whole may have to be discarded.

The alarm of the present invention addresses this problem by means of the connection arrangement 550. By connecting the source and gate of the FET TR3 together, the FET TR3 is switched off and the battery B1 is effectively disconnected from the remaining circuitry of the smoke alarm, as described above. As such, there is no drain from the battery to the alarm circuitry and substantially all of the current available from the charging circuitry can be used to recharge the battery.

It will be appreciated that this solution requires a positive action on the part of the user, i.e. the manual operation of the connection arrangement 550, to enable the battery to recharge. In addition, it requires that the connection arrangement 550 be capable of being switched between closed and open positions selectively and repetitively.

A second solution to this problem is provided for by means of the transistor TR5 which effectively permits automatic disconnection of the battery from the remaining circuitry of the alarm when the charge on the battery B1 falls below a predetermined level.

During periods when the lighting circuit is not energised, and hence the charging circuit is inoperable, the charge on the battery will gradually reduce. The transistor TR5 remains switched off since the potential applied to the base thereof is low (a blocking diode D3 prevents current from the battery B1 raising the potential to a level sufficient to switch the transistor TR5 on). In addition, the FET TR3 remains on, irrespective of the charge on the battery, since the potential applied to the gate of the FET TR3 (determined by the potential on the charging rail 111) is low.

When the recharging circuit is switched on (i.e. the lighting circuit is energised) the voltage on the charging rail 111 increases. However, owing to the large current required to charge the battery and thus drawn by the battery the voltage on the charging rail 111 does not reach a level sufficient to switch the charging transistor TR5 on. Nevertheless, the voltage on the charging rail 111 does rise sufficiently to raise the potential applied to the gate of the FET TR3 to a level sufficient to switch the FET TR3 off, thereby disconnecting the battery B1 from the further circuitry of the alarm. This permits almost all of the current from the charging circuit to be used to charge the battery.

As the charge on the battery rises, the current drawn by the battery decreases and the voltage on the charging rail 111 increases. When the voltage on the charging rail 111 exceeds a predetermined level, the transistor TR5 is switched on and the potential applied to the gate of the FET TR3 is pulled down to the potential on the earth rail 112, thereby switching on the FET TR3 and reconnecting the battery B1 to the further circuitry of the alarm.

Whilst the provision of the transistor TR5 enables the alarm to be recharged even when the battery is fully drained, i.e. has substantially zero charge, without user intervention, it is envisaged that there may be occasions when the user may wish to disconnect the power supply from the detection circuitry of the alarm in order to disable the alarm, for example to permit the alarm to be moved to a new location.

To address this problem, the connection arrangement 550 is preferably arranged to be easily accessible by the user and to be repeatedly connected and disconnected thereby to short out the FET TR3 and hence disconnect the detection circuitry from the power supply as described above.

In order to avoid the situation where the disconnect circuit is operational and the alarm isolated without a user realising, a power on circuit 800 is provided for the disconnect circuit 200 as shown in FIG. 20. The gate of a FET TR10 is connected to the power rail 210 on the alarm side of the transistor TR3 (FIG. 3) by a resistor R92 with the source connected to earth via a light emitting diode or other light source LED1. The drain is connected to the power rail 111 on the charging circuit side of the disconnect circuit by way of resistor R91. Power must be present both on the supply rail 111 and the alarm rail 210 before the LED1 will light and indicate that the alarm is operational.

A further problem with existing alarms is the frequent occurrence of false alarms caused by, for example, cooking fumes, controlled fires such as coal or gas fires or cigarettes or the like. Alarms which frequently trigger falsely are often removed or disabled by the user in some way. Clearly, where it is possible to deactivate a smoke alarm, for example by removing the battery or operating a switch, this can be potentially highly dangerous should a real fire occur during the period the alarm is switched off, regardless of whether the alarm is switched off indefinitely or for a predetermined period of time.

To address this problem, the present invention provides a unique reset function which enables the alarm to be reset following a false alarm without causing the alarm to be switched off. Moreover, this reset function is effected simply and easily merely by flicking on and off a switch on the alarm itself or the light switch of the lighting circuit to which the alarm is connected a preset number of times over a preset time period.

Figure 4:
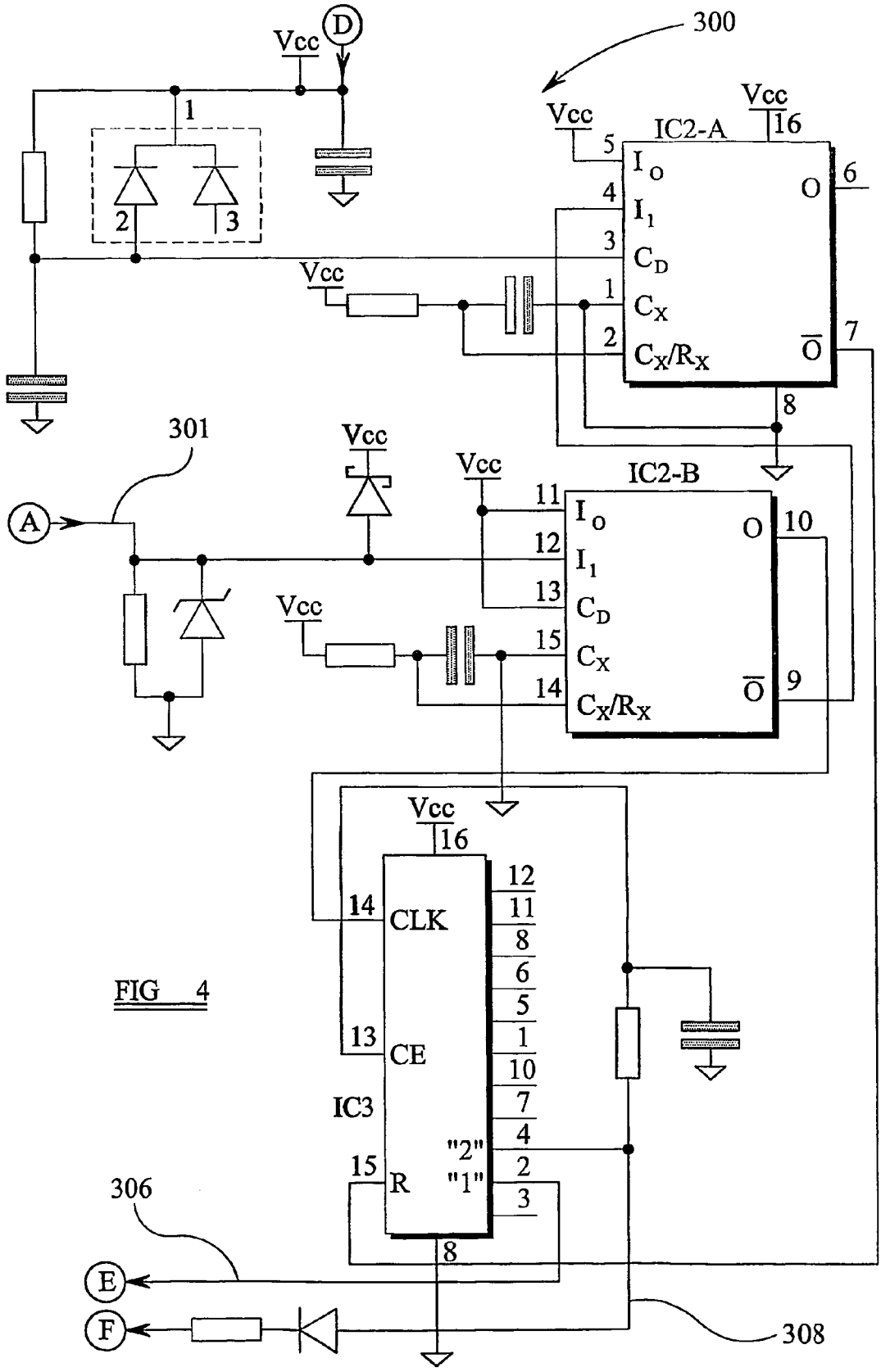
FIG. 4 is a schematic circuit diagram of a control circuit of the alarm of FIG. 1.

FIG. 4 illustrates a control circuit 300 which responds to pulses on an input rail 301 which is connected at A to the positive rail 110. The pulses may thus be provided by the energising and de-energising of the lighting circuit to which the alarm is connected, i.e. by flicking the light switch a preset number of times over a preset time period.

The control circuit 300 includes a first integrated circuit IC2 (shown for convenience as two separate blocks IC2-A, IC2-B in FIG. 4) which is a dual precision monostable integrated circuit. IC2 provides a respective output pulse for each on/off flick of the light switch. The output of IC2 is connected to a second integrated circuit IC3 which is a counter integrated circuit. IC3 has a first output connected to a first output rail 306 and is arranged to apply a voltage to the first output rail 306 in response to a single output pulse from IC2 representing a single energising and de-energising of the lighting circuit (i.e. a single on/off flick of the light switch). IC3 also has a second output connected to a second output rail 308 and is arranged to apply a voltage to the second output rail 308 in response to two successive output pulses of IC2 representing a double energising and de-energising of the lighting circuit (i.e. two on/off flicks of the light switch). The first and second output rails 306, 308 are connected to the detection circuit 400 shown in FIG. 5 at points E and F, respectively.

Figure 5:
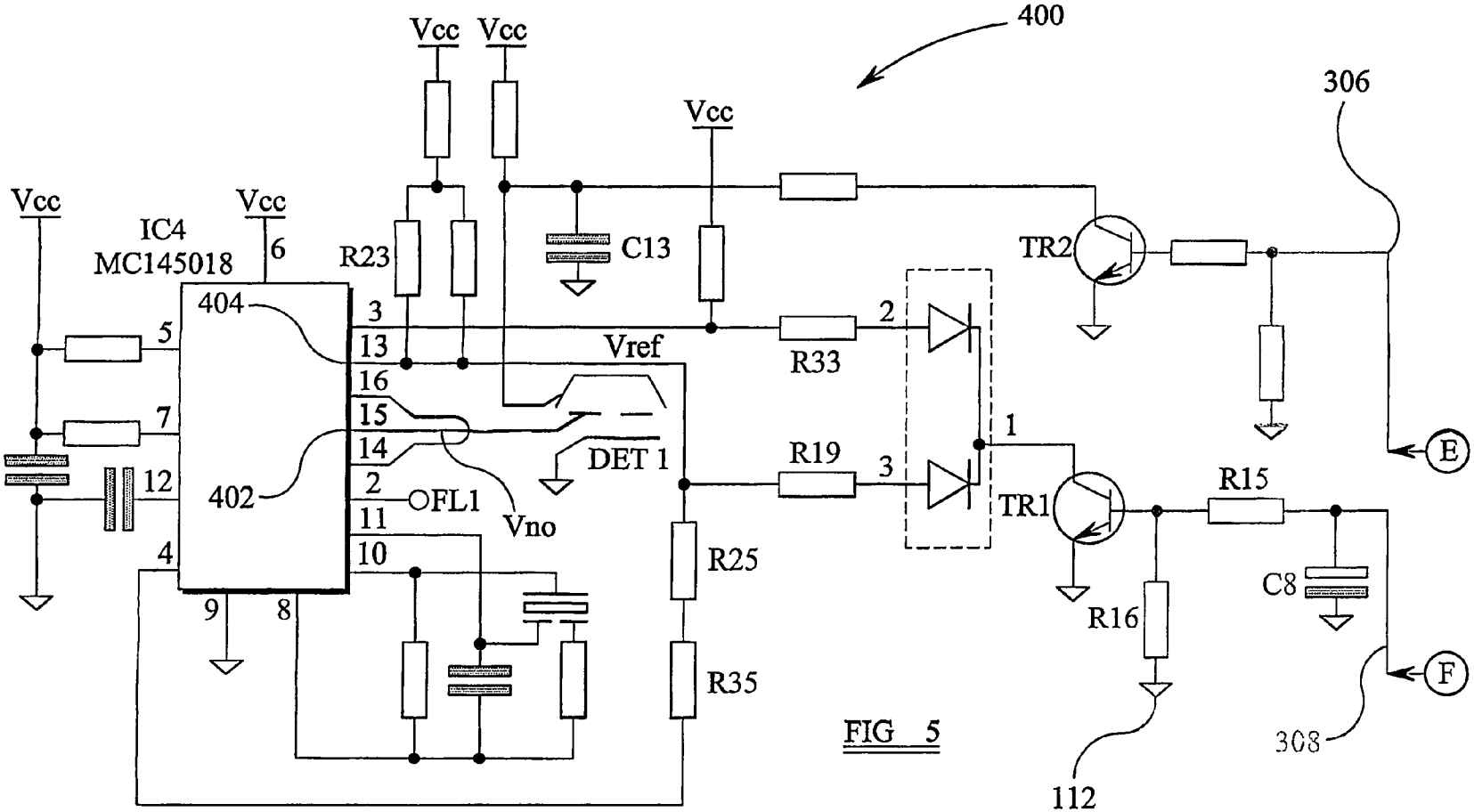
FIG. 5 is a schematic circuit diagram of a detection circuit of the alarm of FIG. 1.

Referring to FIG. 5, the detection circuit 400 of the alarm includes a detector integrated circuit IC4 such as a Motorola MC145018 low-power complementary MOS ionisation smoke detector integrated circuit. The detector integrated circuit IC4 includes an ionisation chamber DET1 which is connected between the supply rail (shown as Vcc) and the earth rail via a limiting resistor R20 and which generates a normal operating voltage Vno which is applied to a detector input 402 of the detector integrated circuit IC4.

The ionisation chamber DET1 is arranged such that when smoke is detected, the voltage Vno, generated by the ionisation chamber and applied to the detector input of the detector integrated circuit IC4, drops. The detector integrated circuit IC4 has a predetermined but adjustable sensitivity level which is set by means of a reference voltage Vref applied to a sensitivity input 404 of the detector integrated circuit IC4. When the voltage Vno applied to the detector input of the detector integrated circuit 104 by the ionisation chamber DET1 drops below Vref, the alarm triggers.

One electrode of a capacitor C13 is connected to a point between the limiting resistor R20 and the ionisation chamber DET1 and also to the collector of a first detector transistor TR2. The other electrode of the capacitor C13 is connected to the earth rail 112. The emitter of the first detector transistor TR2 is connected to the earth rail 112 whilst the base thereof is connected to the first output rail 306 at point E.

If the lighting circuit is energised and de-energised once within a predetermined time period determined by the time constant of an R-C timer circuit associated with IC2, the pulses on the input line 301 are detected by IC2 which sends a control signal to the counter integrated circuit IC3. On receiving the control signal, the counter integrated circuit IC3 applies a voltage to the first output rail 306 which is then applied to the base of the first detector transistor TR2. The first detector transistor TR2 is thus switched on.

Current then flows from the supply rail 210, through the first detector transistor TR2 and the voltage applied to the ionisation chamber is pulled down to a relatively low potential. In addition, the capacitor C13 discharges through the first detector transistor TR2. As a result, the voltage Vno generated by the ionisation chamber DET1 and applied to the detector input of the detector integrated circuit IC4 drops below the reference voltage Vref level set at the sensitivity input. When this occurs, the alarm is triggered.

When the voltage applied to the first output rail 306 by the counter integrated circuit IC3 ceases, the voltage on the first output rail 306 drops to a relatively low potential so that the first detector transistor TR2 switches off. With the timer capacitor C13 discharged, current flows from the supply rail 210 to the capacitor which begins to charge. While the capacitor C13 is charging, the voltage applied to the ionisation chamber DET1 remains low owing to the charging current being drawn by the capacitor. However, as the charge on the capacitor increases, the voltage applied to the ionisation chamber rises. After a period of time, the voltage Vno generated by the ionisation chamber and applied to the detector input of the detector integrated circuit IC4 rises to a value above the reference level Vref set by the sensitivity input. The alarm thus stops triggering.

The above described circuitry allows the testing of the alarm by means of the energising and de-energising of the lighting circuit to which the alarm is connected, i.e. by the flicking of a light switch. It should be noted that, although the description makes reference to a process of "energising and de-energising", this order of operation is not essential and the circuit may be arranged to respond additionally or alternatively to a "de-energising and re-energising" of the lighting circuit.

It will be understood that the testing operation effectively simulates a situation whereby smoke is detected by the ionisation chamber by reducing the voltage supplied to the ionisation chamber and hence reducing the voltage generated thereby below the sensitivity threshold. Thus, both the ionisation chamber and the detector integrated circuit IC4 is tested, rather than simply the alarm sounder as in many conventional alarms.

It will be further understood that the capacitor C13 can act as a timer for maintaining the alarm in a test state for a length of time determined by the time constant of the capacitor and associated resistor. The alarm remains in a test state i.e. active until the charge on the capacitor reaches a predetermined level, irrespective of whether or not the first detector transistor TR2 is on, i.e. whether or not a voltage is still applied to the first output rail 306. The voltage applied by the counter integrated circuit IC3 on the first output rail may thus be in the form of a pulse having a relatively short duration. The pulse must be applied for a duration which need only be long enough to enable the capacitor C13 to discharge.

As described above, the voltage Vref applied to the sensitivity input of the detector integrated circuit IC4 determines the sensitivity threshold at which the alarm triggers. The detector integrated circuit IC4 allows the sensitivity of the alarm to be adjusted to compensate for different operating conditions. Thus, for example, if the alarm were fitted near a kitchen where low levels of smoke are common, the sensitivity of the alarm can be reduced (by reducing Vref) to ensure that only unusually large volumes of smoke would trigger the alarm and thus reduce false alarms.

The sensitivity threshold voltage is set by a plurality of resistors R22, R23, R25 and R35 forming a potential divider to which the sensitivity input 404 is connected. The sensitivity input is also connected, via a resistor R19 and a blocking diode D7, to the collector of a second detector transistor TR1. The emitter of the second detector transistor TR1 is connected to the earth rail 112 while the base is connected, via a limiting resistor R15, to the second output rail 308.

If the lighting circuit is energised and de-energised twice within a predetermined time period determined by the time constant of the R-C timer circuit associated with IC2, the pulses on the input line 301 are detected by IC2 which sends a reset control signal to the counter integrated circuit IC3. On receiving the reset control signal, the counter integrated circuit IC3 applies a voltage to the second output rail 308 which is then applied to the base of the second detector transistor TR1. The second detector transistor TR1 is thus switched on.

Current thus flows from the supply rail 210 through resistor R19 so that the voltage Vref applied to the sensitivity input 404 of the detector integrated circuit IC4 is pulled down to a relatively low potential. Decreasing the voltage Vref applied to the sensitivity input of the detector integrated circuit IC4 has the effect of decreasing the sensitivity of the detector integrated circuit IC4. When the voltage Vref applied to the sensitivity input drops below the voltage Vno applied to the detector input of the detector integrated circuit IC4, the falsely triggering alarm is effectively reset.

False triggering of smoke alarms is usually caused by the ionisation chamber detecting small amounts of smoke or other airborne particulates which results in the voltage Vno generated by the ionisation chamber and applied to the detector input of the detector integrated circuit IC4 being lower than the reference voltage Vref applied to the sensitivity threshold. Reducing the voltage Vref decreases the sensitivity threshold of the alarm. When the sensitivity threshold voltage Vref decreases below the voltage Vno applied by the ionisation chamber DET1 to the detector input, the alarm stops triggering. The alarm is thus effectively reset.

The integrated circuit IC4 also has a low battery charge input and at the same time at the same time as the voltage applied to the sensitivity input is reduced, the voltage applied to the low battery charge input also reduces. This effectively increases the reference voltage for a "low battery" sensor in the detector integrated circuit IC which simulates a low battery condition. This is indicated by a once-per minute "chirp" from the alarm which thus has the dual role of indicating a low battery charge (if occurring continuously) and warning of a low sensitivity condition (if occurring for only a short time).

In addition to the above, the detection circuitry enables the sensitivity threshold value Vref to return from its lowered, reset position to its normal position either by way of a step change or, more preferably, by a gradual change or ramp back to the original level. This is achieved by means of a capacitor C8 connected between the limiting resistor R15 and the earth rail 112.

When the voltage is applied to the second output rail 308 by the counter integrated circuit IC3 and transistor TR1 turns on, the capacitor C8 charges. When the voltage applied to the second output rail 308 ceases the charge on capacitor C8 maintains transistor TR1 ON. However, the capacitor C8 begins to discharge through a current limiting resistor R16 and the voltage applied to the base of the second detector transistor TR1 decreases. As this voltage decreases, the second detector transistor TR1 switches from a conducting state to a substantially non-conducting state. However, this change in state is gradual as the voltage applied to the base decreases. Thus, the voltage applied to the sensitivity input rises, thereby increasing the sensitivity of the detector integrated circuit IC4.

Thus, if the cause of the false alarm is smoke from cooking or other activities, this is unlikely to exceed the reduced sensitivity threshold level and will gradually clear as the sensitivity of the alarm increases. Advantageously, by the time that the normal sensitivity threshold level is reached, the smoke is likely to have cleared.

It will be appreciated that the above described circuitry provides a far greater level of safety for the user than achieved by existing systems. The ability to reset the alarm and reduce its threshold sensitivity by the simple act of flicking a light switch eliminates the requirement of existing alarms for the battery to be removed or otherwise tampered with. In addition, in the event of a real fire after resetting of the alarm, the alarm is still operable and, even in the reduced sensitivity mode, is likely to trigger correctly, thereby advising the user of the real emergency.

Figure 6:
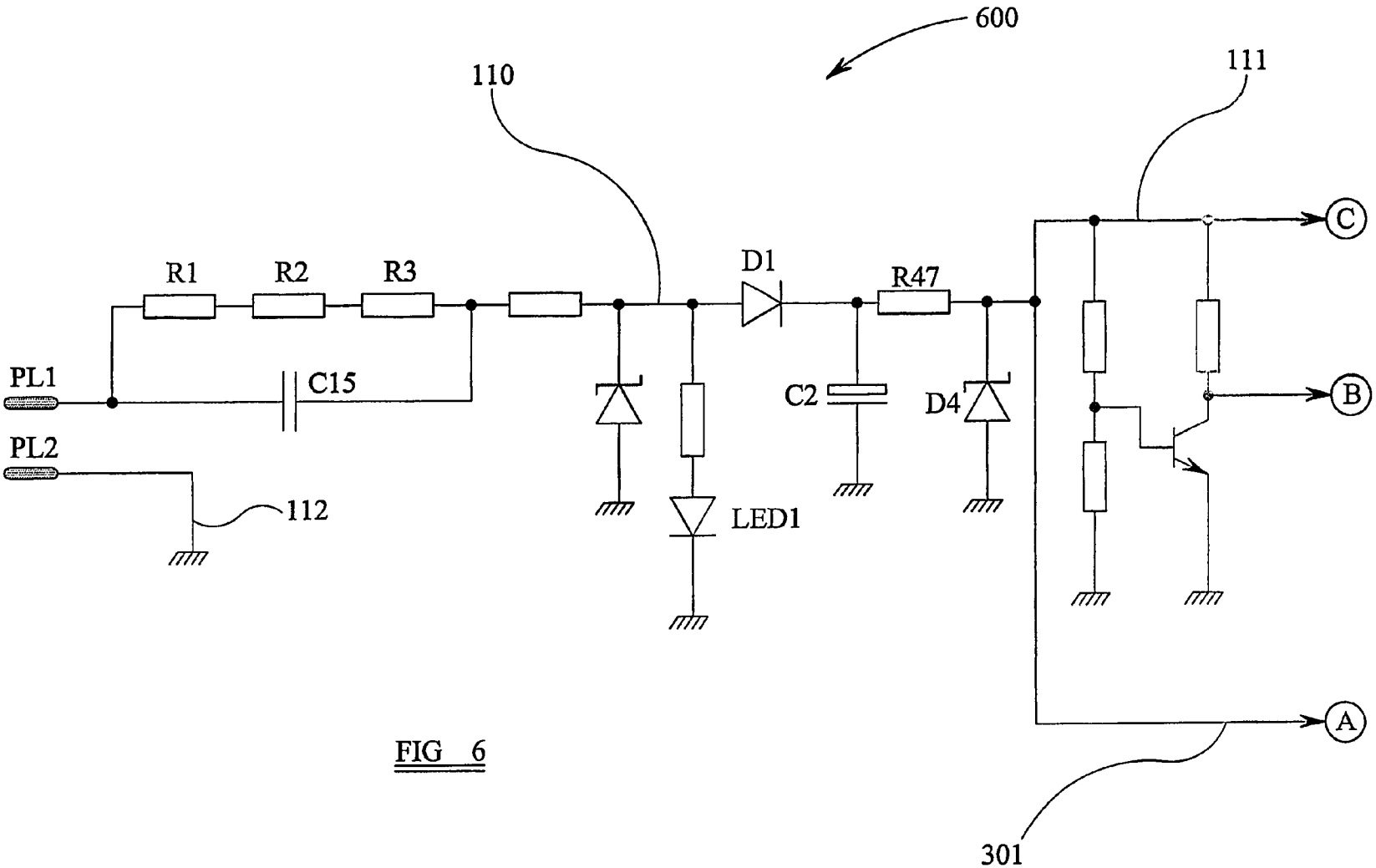
FIG. 6 is a circuit diagram of an alternative form of charging circuit for the alarm of FIG. 1.

FIG. 6 illustrates an alternative form of charging circuit 600 for the alarm. The circuit is broadly similar to that of FIG. 2 and performs a similar function. However, an important difference is that the circuit of FIG. 6 for goes the bridge rectifier BR1. Instead, the earth rail 112 is formed by the neutral input PL2 so that the voltage on the positive rail 110 is only half-wave rectified. The value of the capacitor C2 is increased to increase the smoothing applied to the half-wave rectified current and an additional input capacitor C15 is connected, in parallel with a plurality of series-connected resistors R1, R2, R3, to increase the current limit through the circuit. The resistors R1, R2 and R3 serve to provide a discharge path for the capacitor C15 when the mains power supply is switched off.

A light emitting diode LED1 is connected between the positive rail 110 and the earth rail 112 to indicate when a voltage is being applied to the inputs PL1, PL2, i.e. to indicate when the charging circuit is switched on. Also, the voltage regulator IC1 of FIG. 2 is not included in the charging circuit, being replaced by a resistor R47 and zener diode D4 combination.

Figure 7:
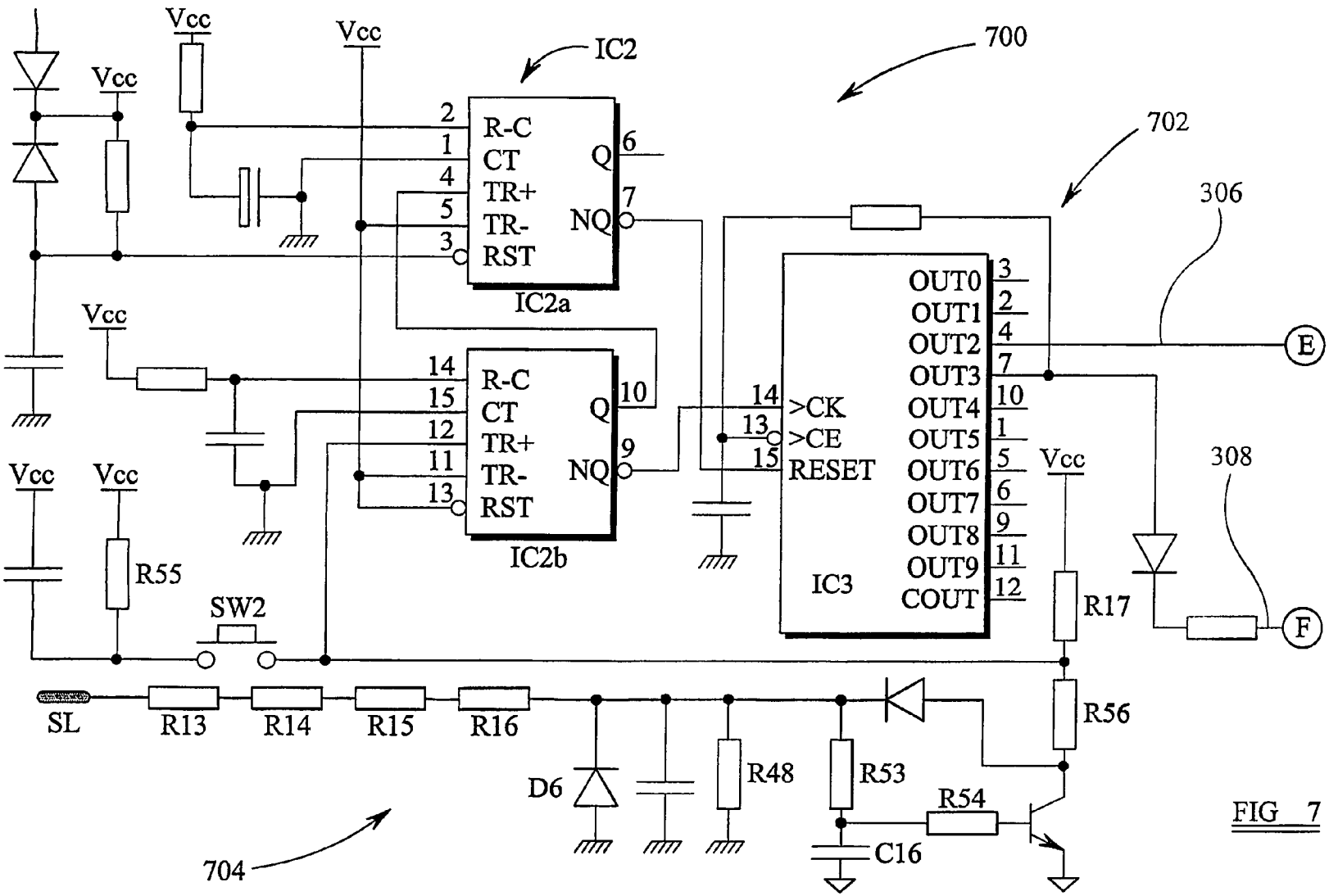
FIG. 7 is a circuit diagram of an alternative form of control circuit for the alarm of FIG. 1.
Figure 10:
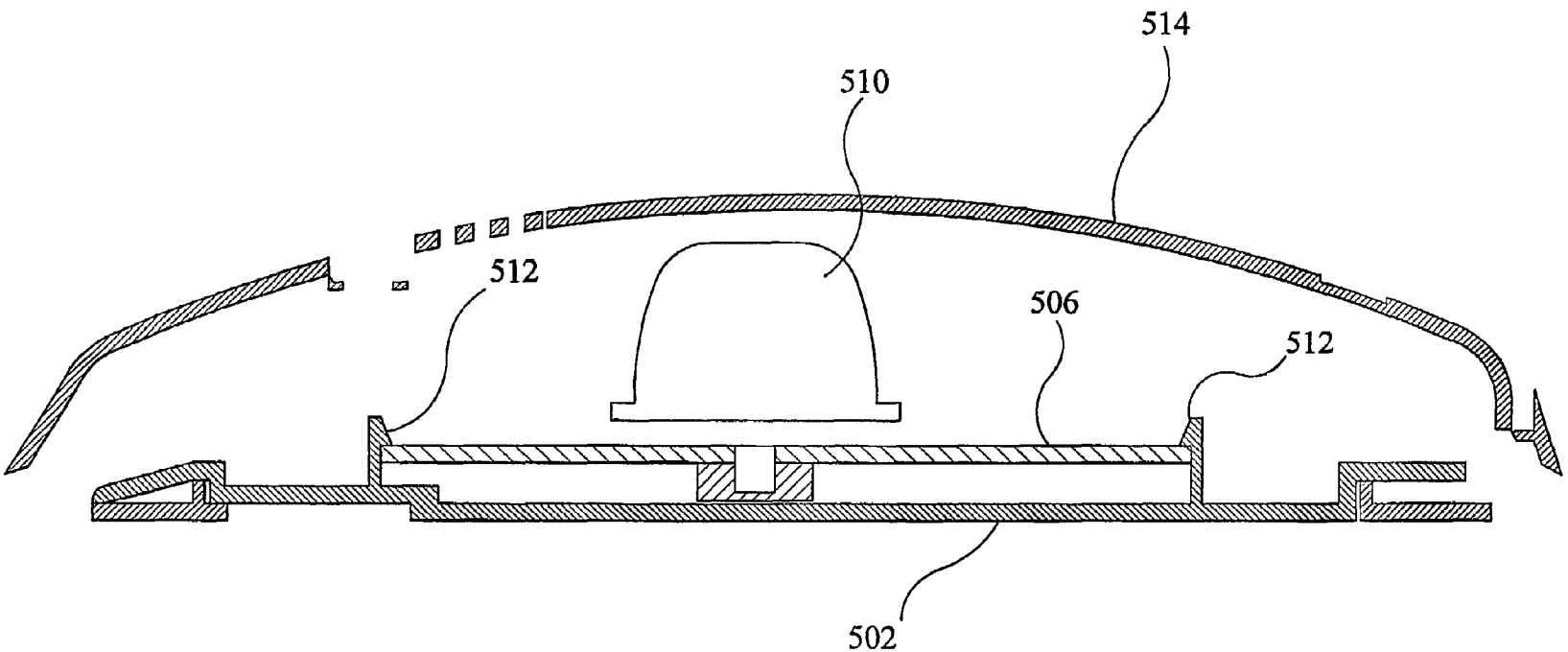
FIG. 10 is a partial section through the alarm of FIG. 8.

FIG. 7 illustrates an alternative form of control circuit 700 for the alarm which has a logic circuit 702 and a signal conditioning circuit 704. Again, the principle of operation of the circuit of FIG. 7 is similar to that of FIG. 4. In this embodiment, however, additional circuitry is included to permit the use of a separate test/reset button SW2 on the alarm itself. This allows the alarm to be tested and/or reset either by the light switch as described above, or by the push button SW2. When the circuit of FIG. 7 is used as the control circuit the terminal PL1 of the charging circuit 200 is connected to the live cable in the lighting circuit and not to the switch live side of the switch. A separate connection through the conditioning circuit 704 as described below is made from the circuit of FIG. 7 to the switch live side of the switch.

The push button SW2 is connected, via a parallel combination of a capacitor C17 and a resistor R55, to the DC supply of the supply rail 210. When the push button SW2 is actuated to close the switch the voltage applied to the trigger input of IC2 goes high. The trigger voltage then decays as the capacitor C17 is charged. Thus, a pulse is applied to the input of IC2. When IC2 receives a preselected number of pulses within a preselected time period it sends a control signal to IC3 which then applies a voltage to output rail 306.

Actuating the push button SW2 a preset number of times over a preset time period causes the alarm to trigger in its test mode as described above with reference to FIGS. 4 and 5.

The control circuit of FIG. 7 also has a switched live input SL which is connected to the light side of the light switch and goes live when the light is switched on.

In the embodiment of FIGS. 2 to 5, when the light switch is ON the signal actually applied to the trigger input of IC2 is a rectified but unsmoothed signal from the bridge rectifier BR1, i.e. a series of positive going pulses. Because the trigger input of IC2 responds to voltage pulses applied thereto, the application of this signal to the trigger input causes IC2 to generate an output pulse which is continuously refreshed so that the output of IC2 is permanently high. This is satisfactory in the embodiment of FIGS. 2 to 5 since the light switch can be switched on and off to simulate "pulses" applied to the trigger input. Thus, for each ON/OFF flick of the light switch a single pulse is generated by IC2. However, if this were the case in the embodiment of FIG. 7 then IC2 would be unable to distinguish the pulse generated by the push button SW2 from the train of pulses applied by the switched live AC signal from the switched live input SL. This would result in the push button SW2 being ineffective whilst the switched live input were energised i.e. whilst the light were switched on.

It is therefore advantageous to prevent continuous retriggering of IC2 even whilst the switched live input SL is energised. In FIG. 7, the switched live input is connected to the trigger input of IC2 via a number of resistors R13 to R16, R56 and a reverse biased diode D7. The anode of the diode D7 is additionally connected to the collector of a transistor TR13 whose emitter is connected to the earth rail 112. The base is connected, via a limiting resistor R54, to the junction between a resistor R53 and a capacitor C16 which are connected in series between the switched live input S and the earth rail.

With the switched live input SL deactivated (i.e. the light switch is off), the voltage applied to the trigger input of IC2 is determined by a potential divider formed by a resistor R17 on the one hand and resistors R56 and R48 on the other hand. R17 is chosen very much larger than both R53 and R48 so that the voltage applied to the trigger input of IC2 is low. The transistor TR13 is switched off and so current from the battery flows to the earth rail through R17, R48 and R56.

When the switched live input SL is energised, i.e. the light switch is switched on, zener diode D6 clips the AC voltage to approximately 12V, effectively rectifying the AC voltage by clamping negative voltages close to earth potential. The voltage applied to the cathode of the diode D7 is greater than that applied to the anode of the diode D7 from the battery. The current from the battery is thus unable to flow through the diode D7 and so the voltage applied to the trigger input of IC2 is raised approximately to the supply voltage, causing IC2 to generate a single output pulse. This is used to set the alarm as described above.

However, when the switched live input S is energised, capacitor C16 begins charging at a rate determined by the time constant of the capacitor C16 and the resistor R53. When the charge on the capacitor C16 reaches a predetermined level, transistor TR13 is switched on. Current from the supply rail thus flows through the transistor TR13 to the earth rail which thereby pulls the voltage applied to the trigger input of IC2 low. This voltage is then clamped low by the transistor TR13 until the switched live input S is de-energised and the capacitor C16 has discharged. During this time, the push button SW2 can be used to test or reset the alarm as described above.

The duration of the output pulse generated by IC2 is such that the voltage applied to the trigger input of IC2 is pulled low before the pulse ends.

While the lighting circuit to which the alarm is connected is energised, therefore, the alarm can be tested by means of the push button SW2. While the lighting circuit is off, the alarm can be tested both by the push button SW2 and by the light switch. It will be understood that if one wishes to test the alarm by means of the light switch when the lighting circuit is energised, the lighting circuit must first be switched off, simply requiring an additional OFF operation of the light switch.

The alarm of the invention is able to be connected to one or more additional alarms so as to provide a network of alarms for use in a building or the like. The detector integrated circuit IC4 is provided with a common input/output (I/O) pin for connection to a similar pin on a like detector integrated circuit via an input/output (I/O) line. Legislation in certain countries dictates that a relatively low voltage on the I/O line should be used to signal an emergency condition so that if a short circuit occurs between the I/O line and, for example, the neutral cable or an earth cable, the alarm will default to the emergency condition.

However, the detector integrated circuit IC4 is arranged to alarm when a relatively high voltage is applied to the I/O pin and, conversely, applies a relatively high voltage to the I/O pin if the ionisation chamber DET1 detects smoke locally. It is therefore necessary, in alarms for use in such countries, to provide an inverter circuit for inverting the signal generated by the detector integrated circuit IC4 for transmission on the I/O line and, equally, for inverting the signal received on the I/O line from a connected alarm. No inverting circuitry may be required when the alarm is to be used in countries which do not carry such legislation.

It will be understood that the system may be configured such that in the event of a false alarm whereby all of the alarms are triggered, the initially falsely triggered alarm can be reset using the technique described above. This will also reset the remaining alarms in the system. Importantly, however, the sensitivity threshold of the falsely triggered alarm will be reduced whilst those remaining alarms in the system will be unaffected and will retain their normal sensitivity threshold levels. It will be appreciated that this adds a far greater safety factor should a fire start elsewhere in a building and minimises inconvenience to the user.

Referring to FIGS. 8 to 15, the alarm of the present invention is provided advantageously with a unique design of housing or casing 500. Conventional ceiling-mounted alarms use a backing plate on which the detection circuitry is mounted. The backing plate has an aperture for allowing the mains circuit power cable to be passed through and attached to appropriate connectors provided in the detection circuitry. Additional apertures are provided as guides for screw holes to enable the backing plate to be screwed to a ceiling fixture. Since the backing plate lies against the ceiling surface with the detector circuitry mounted directly beneath the backing plate within a cover, the alarm has a certain depth which, if it could be reduced, would improve the aesthetics of the alarm.

The alarm of the present invention is conveniently provided with a circular housing which reduces the depth of the alarm. Specifically, the housing 500 comprises a first backing plate 502 generally in the form of an annular ring having a large internal aperture 504. The first backing plate 502 is arranged to be fixed to a ceiling or other fixture. The internal aperture 504 is conveniently used as a guide for the user to cut out the portion of the ceiling defined by the aperture and through which the power cables will pass. The first backing plate also has at least two clips 514 which are preferably equiangularly spaced about the periphery of the plate and project radially inwardly from its inner face. They are raise relative to the rim of the plate in a direction inwardly of the housing.

A clip 520 (FIGS. 14 and 15) is provided on the first backing plate 502 which is attached thereto by a weakened region so that the clip may easily be snapped off from the first backing plate, as described below.

A second backing plate 506 has a raised central portion 508 in which the smoke detector circuitry 510 is seated and is mounted to the first backing plate 502 by means of clips 512 on the first backing plate or any other suitable means such that the raised central portion 508 lies substantially flush with the first backing plate 502. The second backing plate also has clips 516 corresponding to clips 514 which are spaced about the periphery of the plate and project radially inwardly from its inner face towards the backing plate 502.

A cover portion 514 is mounted to either or both of the first and second backing plates 502, 506 for enclosing the circuitry 510 and improving the aesthetic appearance of the alarm. The alarm is considerably more slim-line than existing alarms.

To install the alarm, the user fixes the first backing plate 502 to the ceiling or other fixture using screws or the like. The user then cuts an aperture in the ceiling via the aperture 504 in order to access the cables from the lighting or ring circuit to which the alarm is to be connected. The cables from the lighting or ring circuit are connectable to the alarm by means of a plug or connector 516 which engages with a corresponding socket on the alarm. To facilitate installation, the user mounts the plug 516 onto the clip 520 which holds the plug in position while the users connects the cables from the mains circuit thereto. The clip 520 has fingers 522 with end hooks 524 which clip over the plug 516 to retain the plug. This enables the user to connect the cables to the lighting circuit without the risk of pulling the plug or cables back through the aperture in the ceiling. When the cables have been connected properly, the user detaches the plug from the clip 520 and then detaches the clip 520 from the first backing plate 502. The plug 516 can then be engaged with the socket on the alarm.

Advantageously, the alarm is arranged so that, when the plug 516 and socket are engaged, they lie substantially flush with the first backing plate 502, thereby reducing the depth of the alarm. It will be understood that the terms "plug" and "socket" are used arbitrarily and that the plug may be located on the alarm and the socket used for connection to the cables of the mains circuit.

To connect the second backing plate 506 to the first backing plate 502 the former is offered up to the first backing plate with the clips 516 adjacent clips 514. The second backing plate 506 is then rotated to slide the clips 516 behind the clips 514 and secure the two plates together. A stop can be provided on one or both backing plates to prevent further rotation of the second backing plate 506 relative to tee first when the clips are fully engaged. The dimensions of the clips and their arrangement is such that a secure and firm connection is made between the two backing plates.

Figure 11:
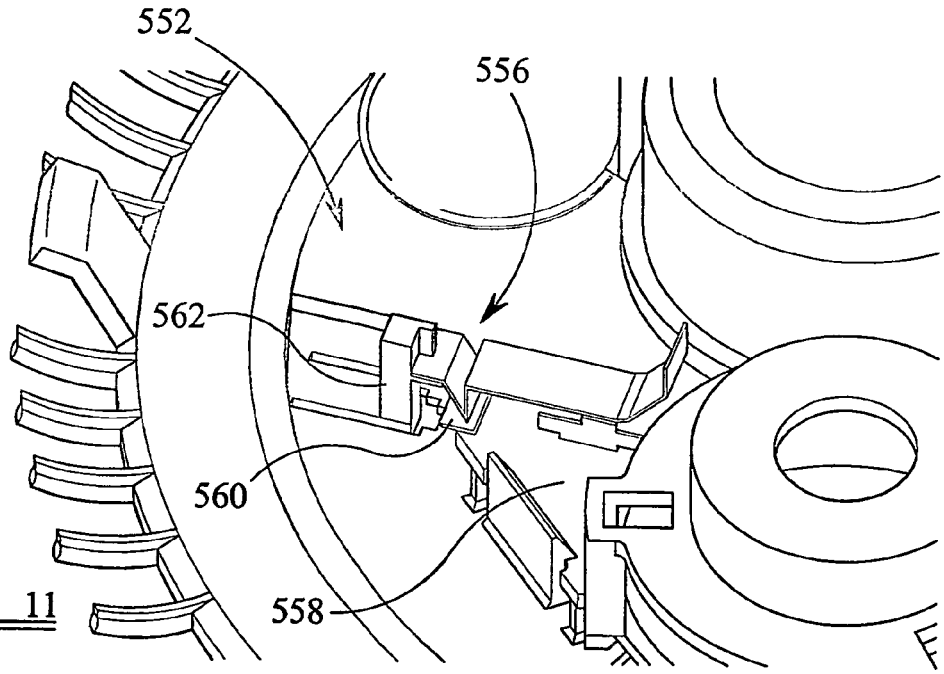
FIG. 11 is a perspective view from above of a mechanical disconnect mechanism for the disconnect circuit of FIG. 3.
Figure 12:
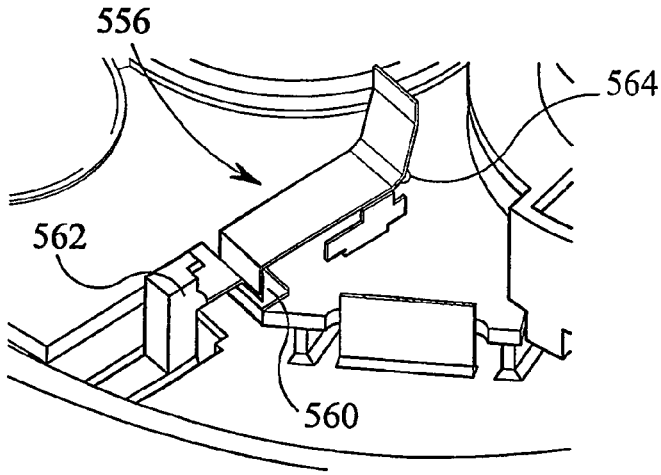
FIG. 12 is a further perspective view from above of the mechanical disconnect mechanism of FIG. 11.
Figure 13:
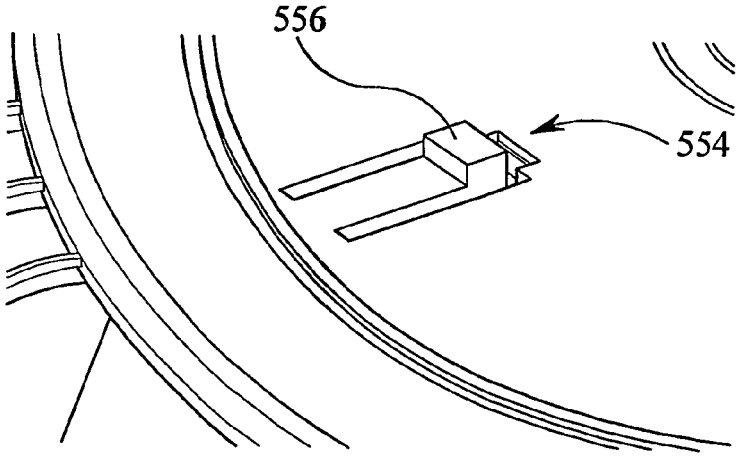
FIG. 13 is a perspective view from below of part of the mechanical disconnect mechanism of FIG. 11.
Figure 14:
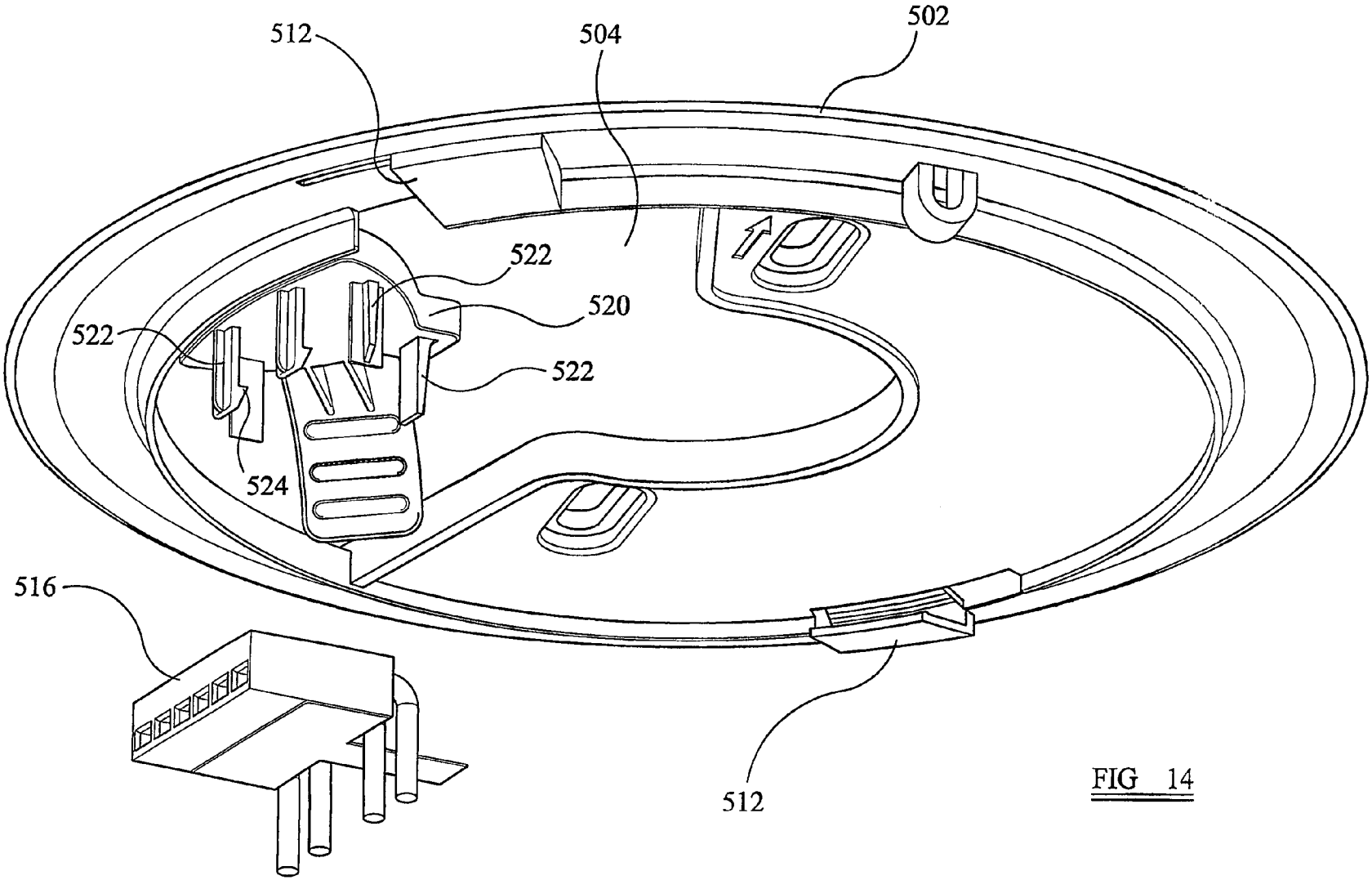
FIG. 14 is a perspective view from below of part of the alarm housing showing a power socket of the alarm and a socket holder in spaced relationship.
Figure 15:
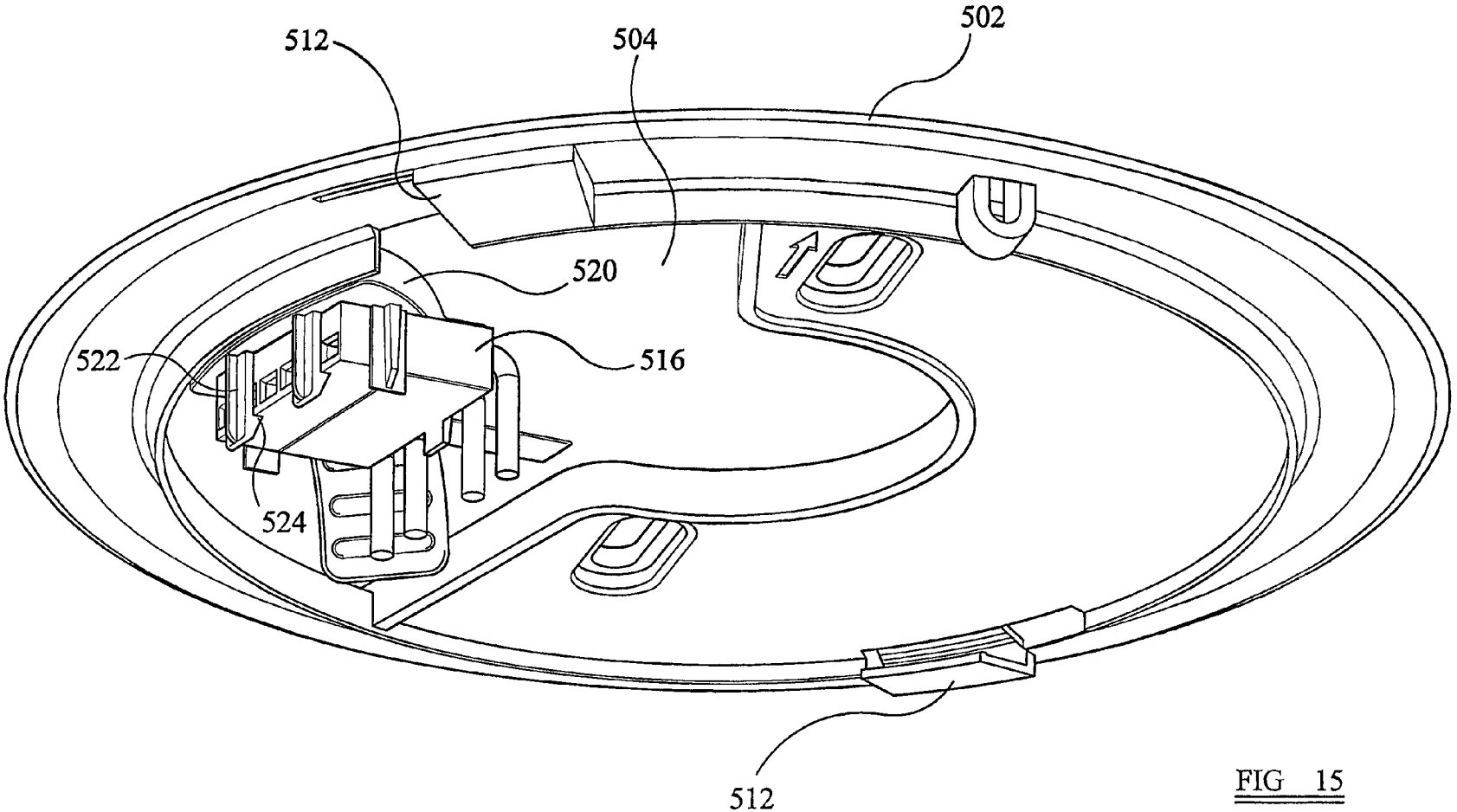
FIG. 15 is a perspective view similar to that of FIG. 14 showing the power socket engaged in the socket holder.

FIGS. 11 to 13 show a preferred form of connection arrangement 550. The arrangement has a push-to-break switch 552 which is actuated by an actuator 554 in the form of a spigot or lever accessed from outside the alarm housing. The lever is generally L-shaped and pressed from the body of the second backing plate 506 with one arm of the "L" extending in the plane of the plate and the other arm 562 extending away from the first backing plate into the body of the housing and contacting a switch arm 556. The switch arm 556 has a depending flange 558 at one end which is mounted on a circuit board and connected to the gate of TR3 whilst the other, free end of the switch arm rests on a pad or contact 560 which is electrically connected to the source of TR3. The switch arm is either a resilient arm which is self biased against the pad or is provided with biasing means such as a coil spring.

The second arm of the lever contacts the free end of the switch arm such that in the normal rest attitude of the lever 554 the free end of the switch arm contacts the pad and shorts the source and gate of TR3 together to disable the alarm. The lever 554 also has a spigot or raised portion formed at the junction of the two arms of the "L", the spigot being raised above the surrounding surface of the plate 506. When the second backing plate 506 is offered to the first backing plate and rotated into engagement, a cooperating portion (such as a raised portion or ramp-like portion) engages the spigot 556 to depress the latter and disengage the free end of the switch arm from the pad 560 and arm the alarm.

In one embodiment, a small, clearly labelled hole 564 is provided on the casing of the alarm. The hole has a metallised internal surface and is electrically connected to the pad 560. Thus, if the switch arm, for whatever reason, fails to contact the pad 560 when the second backing plate 506 is disengaged from the plate 502 a small metal wire, for example a bent paperclip, can be inserted through the hole to short the switch arm to the pad and disconnect the battery and silence the alarm.

Alternatively, a push button switch, accessible directly or through a hole by means of a narrow object such as a pencil, a pin or a tooth pick etc., could be employed to enable the user manually to disconnect the power supply from the detection circuitry.

In one embodiment, the switch is arranged so that the power supply, is disconnected from the detection circuitry by default and actuation of the switch causes the power supply to be connected to the detection circuitry. The switch may be actuated by means of a pin located on a cover or housing portion arranged to fit over the alarm once installed. Fitting of the cover to the alarm causes the pin to engage with the switch thereby re-connecting the power supply to the detection circuitry.

Figure 16:
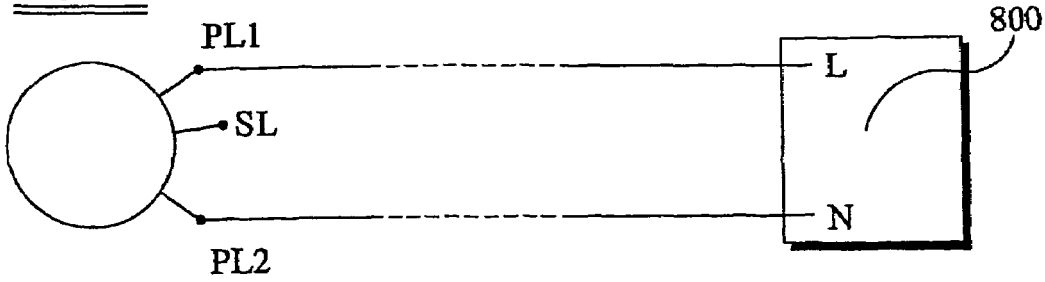
FIG. 16 is a schematic diagram showing a first method of connection of the alarm to the consumer wiring system.
Figure 17:
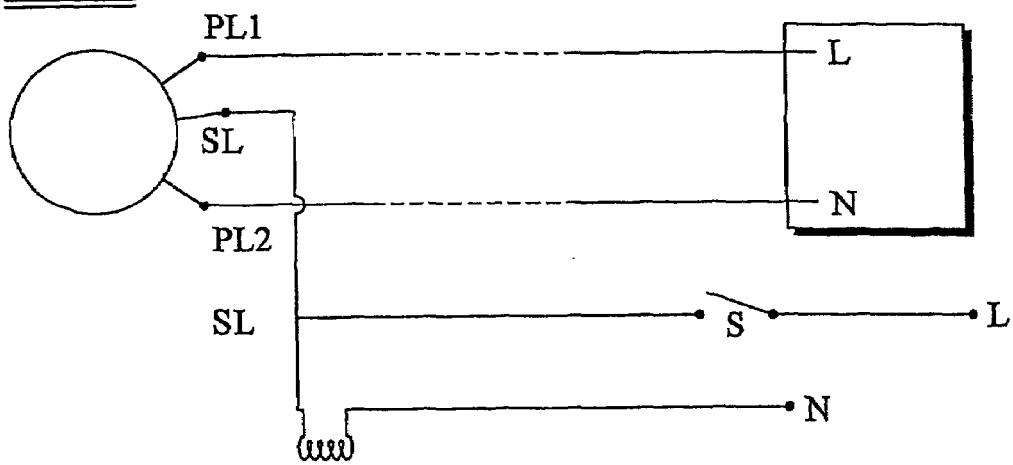
FIG. 17 is a schematic diagram showing a second method of connection of the alarm to the consumer wiring system.
Figure 18:
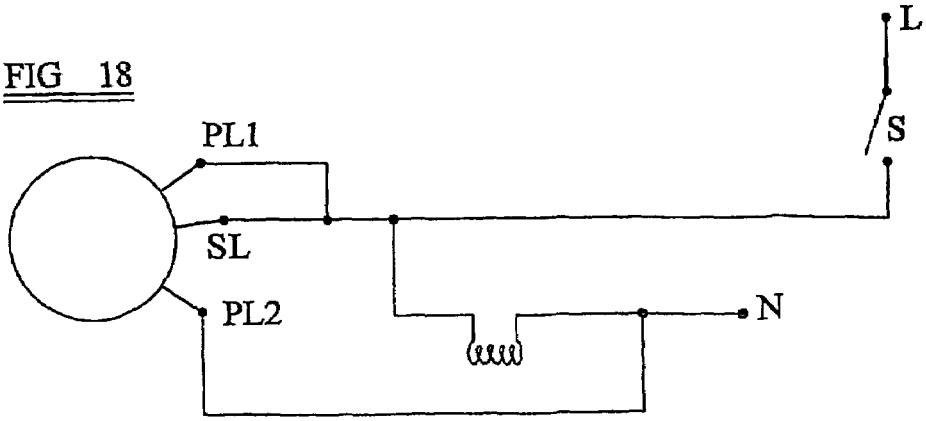
FIG. 18 is a schematic diagram showing a third method of connection of the alarm to the consumer wiring system.

Referring now to FIGS. 16 to 18 these show three ways in which the alarm can be connected to a lighting circuit.

In FIG. 16, the live and neutral terminals PL1, PL2 are connected to a consumer board 800 or other power distribution board. This is a standard configuration where the switch live SL terminal is not used. It will be appreciated that for this arrangement an alarm with the control circuit of FIG. 7 is used and the setting and resetting is achieved by use of the switch SW2 on the alarm housing. The alarm is wired to permanent live and neutral cables of a ring main circuit or similar. The mains circuit powers the alarm at all times except in the event of, for example, a power cut whereby the alarm is powered by the battery acting as a back-up power supply.

In FIG. 17, the live and neutral terminals PL1, PL2 are connected to the consumer board 800 or other power distribution board or to a ceiling rose for a light The switch live terminal SL is connected to the light side of the light switch. In this arrangement an alarm with the control circuit of FIG. 7 is used and the setting and resetting is achieved either by use of the light switch or by use of the switch SW2 on the alarm housing. Here, the alarm is wired to permanent live and neutral cables and also to a switched live cable. The alarm is powered at all times by the mains circuit but can be tested and/or reset by the push button switch SW2 and/or the light switch.

In FIG. 18, the live terminal PL1 and switch live terminal SL are connected together and to the switched live cable of a lighting circuit. Here, the light switch can be used to test/reset the alarm in addition to the push button switch SW2, where present, and when the lighting circuit is de-energised (i.e. the light is not in use), the alarm is powered by the battery.

The circuits shown in the accompanying drawings may be modified to achieve variations on the functions described. For example, the number of operations of the push button switch SW2 for a given function can be matched to the number of operations of the light switch. Various additional features can be added and activated by increasing the number of operations of the push button switch SW2 and/or the light switch. The light switch operation can be set to detect "off-on-off" sequences in addition to or alternatively of "on-off-on" sequences. Advantageously, only a single push button switch SW2, which could be any suitable form of switch, and/or a single light switch is needed to operate all of the functions of the alarm.

An interconnect for communication between two or more alarms can be included but is entirely optional.

In a further embodiment, the alarm includes a relay or other such switching device which, when the alarm is triggered, connects the permanent live cable of the power supply (where present) to a switched live cable of a lighting circuit. This provides the advantageous effect that, when the alarm is triggered, the light connected to the switched live cable is automically illuminated. FIG. 19 shows a modification to the alarm circuit to achieve this. In FIG. 19 the charging circuit 100 is connected to the live and neutral of a lighting circuit power supply. The signal conditioning circuit 704 has as an input the switched live output of the light switch S and is connected to the logic circuit 792 as described earlier with reference to FIG. 7. In addition, the live of the power supply is connected to the switched live SL input of the circuit 704 by way of a power conditioning circuit 710 and a relay 712 which is conveniently a solenoid operated 240v relay. The relay 712 is actuated by a signal from the detection circuit 400 when the alarm is actuated in order to switch on the light LB when the latter is off. The power conditioning circuit 710 is at its simplest a diode 714.

When an alarm condition is present, the relay 712 is actuated to connect the live rail to the light LB by way of the diode 714.

When a test or reset signal is applied to the signal conditioning circuit by flicking the switch S on and off one or more times the AC mains signal applied to the circuit 704 via the relay 702 is prevented from triggering the alarm. The diode 714 provides half wave rectification of the AC mains to allow only negative going pulses through the relay 714 to the signal conditioning circuit 704 when the relay is closed. However, the circuit 704 only senses positive going pulses, as a result of which the mains pulses which power the light through the relay 712 do not trigger the alarm.

In addition, all interconnected alarms and lights could be switched on so that, in the event of a fire in a tall building such as a three-storey town house, an escape route would be illuminated thereby.

It will be appreciated that the present invention provides a significant improvement over existing alarms. It will be understood that the various features of the alarm described above are not mutually inclusive and can be used independently of the other features if required. For example, the casing/housing described for the alarm may be applicable to alarms other than those connectable to a lighting circuit.

The disconnect circuit may find application in devices other than smoke alarms or may be modified for use with smoke alarms such that installation of the alarm or connection to the mains circuit automatically reconnects the power supply to the detection circuitry. This may be particularly the case for alarms such as those described in co-pending application No. WO 00/58924, the contents of which are herein incorporated by reference.

The invention claimed is:

1. An alarm for detecting radiation and/or pollutants having:

a housing;

an alarm circuit including a detector capable of detecting said radiation and/or pollutants;

a first electrical connection directly connected to one of an external live power cable of a main circuit and a light side of a switch for a lighting circuit for supplying external power to said alarm circuit;

a second electrical connection connectable to said light side of said switch for the lighting circuit, wherein the first electrical connection supplies external power to the alarm circuit independent of the connection to the second electrical connection;

a circuit connecting said first electrical connection to said alarm circuit for supplying said external power to said alarm circuit;

a first switch mounted on said alarm housing and actuable by a user to generate a respective pulse for each actuation thereby;

and a control circuit responsive to receipt of a preselected number of pulses, from either the second electrical connection or the first switch, over a preselected time period to apply a preset control signal to said alarm circuit;

wherein said alarm circuit is responsive to said preset control signal to reset or test said alarm in dependence on said preset control signal.

2. An alarm as claimed in claim 1 wherein:

said second electrical connection is operable to receive pulses caused by user actuation of said first switch between its on and off states and apply said pulses to said control circuit thereby to cause a preset control signal to be applied to said alarm circuit in response to generation of said preselected number of pulses over said preselected time period.

3. An alarm as claimed in claim 1 further comprising a switch for an external light source and actuable in response to generation of a preselected control signal to energize said light source.

4. An alarm as claimed in claim 1 further comprising a relay and a light source wherein said relay is actuable in response to generation of a preselected control signal to energize said light source.

5. An alarm as claimed in claim 1 wherein when said preselected number of pulses over said preselected time period is one, said control circuit is operable to apply a preset control signal to said alarm circuit thereby to reset said alarm.

6. An alarm as claimed in claim 1 wherein when said preselected number of pulses over said preselected time period is one, said control circuit is operable to apply a preset control signal to said alarm circuit thereby to test said alarm.

7. An alarm as claimed in claim 1 wherein when said preselected number of pulses over said preselected time period is two, said control circuit is operable to apply a preset control signal to said alarm circuit thereby to test said alarm.

8. An alarm as claimed in claim 6 wherein when said preselected number of pulses over said preselected time period is two, said control circuit is operable to apply a preset control signal to said alarm circuit thereby to reset said alarm.

9. An alarm circuit as claimed in claim 1 wherein said alarm circuit is capable of reducing the sensitivity of said detector.

10. An alarm as claimed in claim 9 wherein the capability of the alarm circuit to reduce the sensitivity of said detector is operable in response to generation of a reset control signal by said control circuit to reduce the sensitivity of said detector for a preselected time period thereby to reset said alarm.

11. An alarm circuit as claimed in claim 1 wherein said alarm circuit is capable of increasing the sensitivity of said detector.

12. An alarm as claimed in claim 11 wherein the capability of the alarm circuit to increase the sensitivity of said detector is operable in response to generation of a test control signal by said control circuit to increase the sensitivity of said detector for a preselected time period thereby to test said alarm.

13. An alarm as claimed in claim 1 further comprising:

a battery for supplying power to said alarm.

14. An alarm as claimed in claim 13 further comprising:

a charging circuit including said first electrical connection for supplying power to a power rail for said alarm circuit and for charging said battery.

15. An alarm as claimed in claim 13 further comprising an isolator for selectably electrically disconnecting said battery from said alarm circuit thereby to minimize leakage from said battery when said alarm is inactive.

16. An alarm as claimed in claim 15 wherein:

said isolator comprises a second switch in said power rail switchable between a first, conducting state connecting said battery to said alarm and a second, non-conduction state disconnecting said battery from said alarm.

17. An alarm as claimed in claim 16 wherein said charging circuit comprises a third switch switchable between a first, conducting state and a second, non-conducting state in dependence on the voltage on said power rail; and wherein:

when said third switch is in said first, conducting state said third switch is operable to retain said isolating second switch in its conducting state;

and when said third switch is in said second, non-conducting state the state of said third switch is dependent on the voltage on said power rail such that said second switch is non-conducting in response to said voltage on said power rail being below a preselected value indicating a low battery charge, thereby to disarm said alarm during charging of said battery.

18. An alarm as claimed in claim 17 further comprising a disconnector actuable to switch said third switch into its non-conducting state thereby disabling said third switch and preventing actuation of said alarm.

19. An alarm as claimed in claim 18 wherein said disconnector comprises a button movable between a first, OFF position wherein said third switch is rendered non-conducting and a second, ON position wherein said third switch is enabled.

20. An alarm as claimed in claim 18 wherein:

said third switch means-is a multi electrode semiconductor device having a control electrode for controlling conduction between further electrodes thereof;

and said button is movable into its first, OFF position to vary the potential on control gate thereby to render said third switch non-conducting.

21. An alarm as claimed in claim 19 wherein:

said housing comprises:

a first backing plate for mounting on a surface;

a second backing plate detachably mountable on said first backing plate;

and a cover for covering said backing plates;

and wherein the arrangement of said disconnector is such that engagement of said second backing plate on said first backing plate moves said disconnector into its second, ON position thereby to enable said third switch and disengagement of said second backing plate from said first backing plate moves said disconnector into its first, OFF position thereby to disable said third switch.

22. An alarm as claimed in claim 15 further comprising an indicator operable in response to power on said voltage rail downstream of said isolator to indicate that said alarm is enabled.

23. The alarm of claim 1, further comprising:

a light switch for a light source, said light switch being actuable in response to triggering of said alarm to energize said light source.

24. The alarm of claim 23 wherein said light switch comprises a relay and said light source is external to said alarm.

25. The alarm of claim 23 wherein said light source is mounted in said alarm.

26. An alarm as claimed in claim 1 wherein:

when said first or second electrical connection is connected to said light side of said light switch for the lighting circuit said second electrical connection is operable to receive pulses caused by user actuation of said light switch between its on and off states and apply said pulses to said control circuit thereby to cause a preset control signal to be applied to said alarm circuit in response to generation of said preselected number of pulses over said preselected time period.

* * * * *